US008387681B2

(12) United States Patent
Kawaguchi et al.

(10) Patent No.: US 8,387,681 B2
(45) Date of Patent: Mar. 5, 2013

(54) STRAND GUIDING APPARATUS FOR CONTINUOUS CASTING EQUIPMENT

(75) Inventors: Hiroshi Kawaguchi, Takasago (JP); Fumiki Asano, Takasago (JP); Kazunori Okada, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 6 days.

(21) Appl. No.: 12/978,880

(22) Filed: Dec. 27, 2010

(65) Prior Publication Data

US 2011/0155342 A1 Jun. 30, 2011

(30) Foreign Application Priority Data

Dec. 28, 2009 (JP) ..... 2009-297592

(51) Int. Cl.
*B22D 11/128* (2006.01)
*B22D 11/20* (2006.01)

(52) U.S. Cl. ..... 164/413; 164/154.5; 164/442; 164/454

(58) Field of Classification Search ..... 164/441, 164/442, 447, 448, 484, 454, 413, 154.5
See application file for complete search history.

(56) References Cited

U.S. PATENT DOCUMENTS 4,106,550 A * 8/1978 Tsuchida ..... 164/448
4,195,684 A * 4/1980 Tsuchida ..... 164/416
4,197,904 A * 4/1980 Streubel et al. ..... 164/448
5,293,925 A * 3/1994 Kumashiro et al. ..... 164/454
5,533,374 A * 7/1996 Seto et al. ..... 72/247
6,062,295 A * 5/2000 Greiwe ..... 164/448
6,959,578 B2 * 11/2005 Horii et al. ..... 72/237
6,973,957 B2 * 12/2005 Naito ..... 164/485

FOREIGN PATENT DOCUMENTS

JP 59-110453 A 6/1984
JP 2-32062 7/1990
JP 3-70847 U 7/1991

(Continued)

OTHER PUBLICATIONS

International Search Report issued Sep. 6, 2011, in Patent Application No. PCT/JP2011/003658.

(Continued)

*Primary Examiner* — Kevin P Kerns
(74) *Attorney, Agent, or Firm* — Oblon, Spivak, McClelland, Maier & Neustadt, L.L.P.

(57) ABSTRACT

A strand guiding apparatus includes a plurality of pairs of rollers arranged along a moving direction of a strand, a plurality of drive motors for generating driving forces to drive the pairs of rollers, a plurality of worm reducers for transmitting the driving forces of the drive motors to the pairs of rollers while reducing the rotational speed of the drive motors, each worm reducer having a worm extending in a direction orthogonal to an axis of the corresponding roller, and operable to transmit a load occurring at the roller to the corresponding drive motor, and a control unit for controlling the respective rotational speeds of the rollers and/or the respective driving forces of the drive motors based on the load to the drive motors. The reliable control for drive rollers can be attained to have a proper rotational speed without causing a reduction in surface quality and chatter in a strand guiding apparatus for continuous casting equipment using worm reducers.

13 Claims, 6 Drawing Sheets

FOREIGN PATENT DOCUMENTS

| | | | |
|---|---|---|---|
| JP | 4-94136 | | 8/1992 |
| JP | 8-74974 | A | 3/1996 |
| JP | 2001-300706 | | 10/2001 |
| JP | 2006-224131 | A | 8/2006 |
| JP | 2008-260026 | | 10/2008 |

OTHER PUBLICATIONS

Japanese Office Action issued Jan. 10, 2012 in patent application No. 2009-297592 with English translation.

* cited by examiner

STRAND GUIDING APPARATUS FOR CONTINUOUS CASTING EQUIPMENT

BACKGROUND OF THE INVENTION

1. Field of the Invention

The present invention relates to a strand guiding apparatus installed in continuous casting equipment.

2. Description of the Background Art

In continuous casting equipment, a metal strand is allowed to solidify while being withdrawn downward from a bottom of a mold using a strand guiding apparatus, thereby producing cast pieces such as billets and slabs. Many patent documents refer to strand guiding apparatuses.

For example, Japanese Examined Patent Publication No. H02-32062 discloses a strand guiding apparatus including a plurality of pairs of drive rollers along a moving direction of a strand. Each pair of drive rollers is provided to sandwich the strand to drivingly guide the strand. The driving force from a drive motor is transmitted to each drive roller via a speed reducer. In the strand guiding apparatus of this patent document, a worm reducer is used as the speed reducer.

There are roughly three reasons why such worm reducers are used. The first reason relates to the installation space limitation. Specifically, multi-strand continuous casting is carried out in continuous casting equipment of recent years in view of the productiveness, and casting is carried out in multi-strand continuous casting equipment with strand guiding apparatuses arranged in a horizontal direction. In other words, strand guiding apparatuses are arranged on the opposite sides of a strand guiding apparatus. Accordingly, enough installation spaces for drive motors and the like cannot be obtained at lateral sides in many cases. However, worm reducers, which can transmit a driving force in an orthogonal direction, can eliminate the likelihood that a positional interference occurs between drive motors of one strand guiding apparatus and those of another strand guiding apparatus.

The second reason relates to the installation space of a worm reducer. Specifically, in the worm reducer, a large speed reduction ratio can be accomplished simply by reducing the lead angle of a worm without changing the outer dimensions of the speed reducer. Since a large speed reduction ratio can be accomplished by a worm reducer, high performance is not required for a primary speed reducer, which thus makes it possible to employ a smaller-sized primary speed reducer and a universal joint. Therefore, worm reducers capable of giving a large speed reduction ratio by a compact mechanism without taking up a large installation space are suitably used in multi-strand continuous casting equipment having a limited installation space.

The third reason relates to the prevention of strand drop. Specifically, a worm reducer having a large gear ratio of 1/40 to 1/60 will cause self-locking which is specific to a drive mechanism using a worm. In the state where this self-locking works, the drive roller cannot rotate the drive motor while the drive motor can rotate the drive roller. In other words, even if the drive motor stops for a certain reason, e.g., power stoppage, the drive rollers are locked in a stopped state when the worm reducer causes self-locking, therefore there is no likelihood that the strand drops. Thus, worm reducers whose gear ratios are conventionally set at a large value of 1/40 to 1/60 are preferably used particularly in vertical continuous casting equipment which is likely to receive the weight of strand.

As described above, worm reducers used in continuous casting equipment are normally set at such a large gear ratio that self-locking is likely to work to prevent the strand from dropping under undesired conditions, e.g., power stoppage.

However, large weight of the strand or a dummy bar acts on drive rollers in continuous casting equipment, particularly in vertical continuous casting equipment during a start operation using the dummy bar and during a casting operation, which consequently causes drive rollers to rotate, i.e., "reverse-powering", owing to a friction force generated on contact surfaces of the drive roller and the strand due to a falling force exerted from the strand or the dummy bar.

However, in the case where the worm reducer is set at such a large gear ratio as to cause self-locking as described above, no load is transmitted from the drive roller to the drive motor. Thus, the drive motor does not sense that the drive roller is in the "reverse-powering" condition, and it becomes difficult to control the output of the drive motor based on the load sensed by the drive motor. As a result, in the case of holding or withdrawing the strand or the dummy bar using a plurality of drive motors, the drive motor continues to generate driving forces even for the case that outputs of the drive roller should be reduced, thereby leading to the problem that excessive loads damage the worm reducer.

It is possible to control a plurality of drive rollers to have a predetermined rotational speed regardless of loads on the drive motor. However, the respective diameters of the drive rollers slightly vary due to manufacturing errors and friction. Thus, the respective circumferential speeds of the drive rollers are not strictly equal to one another even if the rotational speeds are the same. Further, the moving speed of the strand changes by as much as a pressure control at a lower portion of the strand guiding apparatus, particularly at a lower portion of a strand pressure controller. Therefore, it is also difficult to accurately conform the circumferential speeds of all the drive rollers to the moving speed of the strand.

More specifically, even if it is tried to control the rotational speed of the drive rollers, there is a possibility that such a control leads to a situation where the circumferential speed of a certain drive roller is faster than the moving speed of the strand, but that of another drive roller is slower, i.e., the circumferential speed differs among the drive rollers. In the case where the strand is guided by the drive rollers whose circumferential speeds are different, there may be a problem that slippage occurs between the strand and surfaces of the drive rollers to lower the surface quality of the strand, and a problem that a force acts in a tensile direction or compression direction to cause "chatter" of the strand. Of course, large loads transmitted to the worm reducer, e.g., teeth of the worm and the worm wheel, will may break them. This is the big problem.

SUMMARY OF THE INVENTION

An object of the present invention is to provide a strand guiding apparatus for continuous casting equipment which has overcome the above-mentioned problems.

Another object of the present invention is to provide a strand guiding apparatus for continuous casting equipment which can reliably control drive rollers so as to have a proper rotational speed without causing a reduction in the surface quality and chatter while using worm reducers capable of obtaining a large speed reduction ratio by a compact mechanism.

According to an aspect of the present invention, a strand guiding apparatus for continuous casting equipment comprises a pair of rollers to sandwich a strand; a drive motor for generating a driving force to drive at least one of the pair of rollers; a worm reducer for transmitting the driving force of the drive motor to the at least one of the pair of rollers while reducing the rotational speed of the drive motor, the worm reducer having a worm extending in a direction orthogonal to an axis of the at least one of the pair of rollers, and operable to transmit a load occurring at the roller to the drive motor; and a control unit for controlling the rotational speed of the roller and/or the driving force of the drive motor based on the load to the drive motor.

The strand guiding apparatus can control the rollers at a proper rotational speed without lowering the surface quality of the strand and causing chatter, while keeping the compact arrangement.

These and other objects, features, aspects, and advantages of the present invention will become more apparent from the following detailed description of the preferred embodiments/examples with reference to the accompanying drawings.

DETAILED DESCRIPTION OF PREFERRED EMBODIMENTS OF THE INVENTION

The present inventors studied the possibility of controlling the rotational speed of a drive roller somehow based on a load transmitted to a drive motor while taking advantage of a worm reducer known to ensure a large speed reduction ratio by a compact mechanism. The present invention was completed based on knowledge that if the gear ratio of the worm reducer is set at a small value, self-locking does not occur and a load occurring on the drive roller is transmitted to the drive motor, and the rotational speed of the drive roller can be accurately controlled based on the load transmitted to the drive motor without causing a reduction in the surface quality and chatter.

Figure 1:
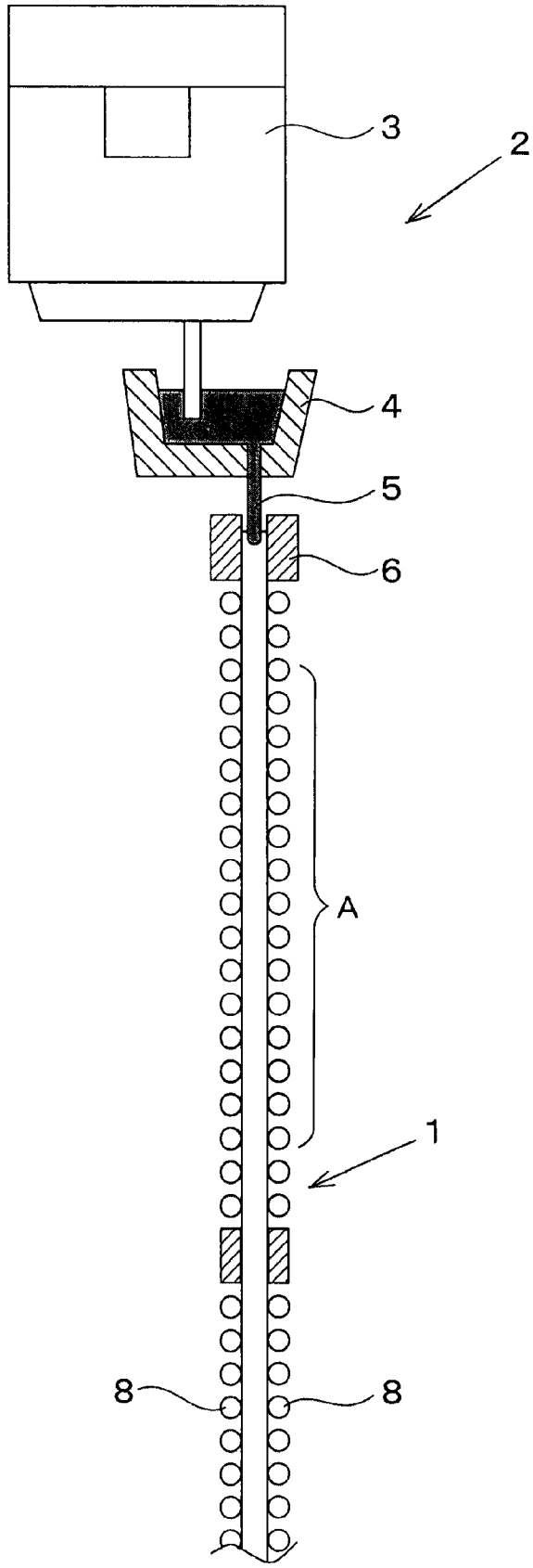
FIG. 1 is a schematic diagram showing a basic construction of a strand guiding apparatus according to an embodiment of the invention.

A strand guiding apparatus for continuous casting equipment embodying the present invention will be described in detail with reference to the drawings. FIG. 1 shows a vertical continuous casting equipment 2 in which a strand guiding apparatus 1 embodying the present invention is installed.

The continuous casting equipment 2 is equipment to continuously cast a strand S for blooms, billets or slabs, and includes a tundish 4 in the form of a bottomed box for temporarily storing molten steel supplied from a ladle 3, a mold 6 to which the molten steel is supplied from a submerged nozzle 5 provided at a bottom of the tundish 4, and the strand guiding apparatus 1 provided below the mold 6 along a casting direction or longitudinal direction. In the continuous casting equipment 2, casting is carried out by withdrawing a long strand S having a substantially rectangular cross section vertically downward from the mold 6 using the strand guiding apparatus 1.

Figure 2:
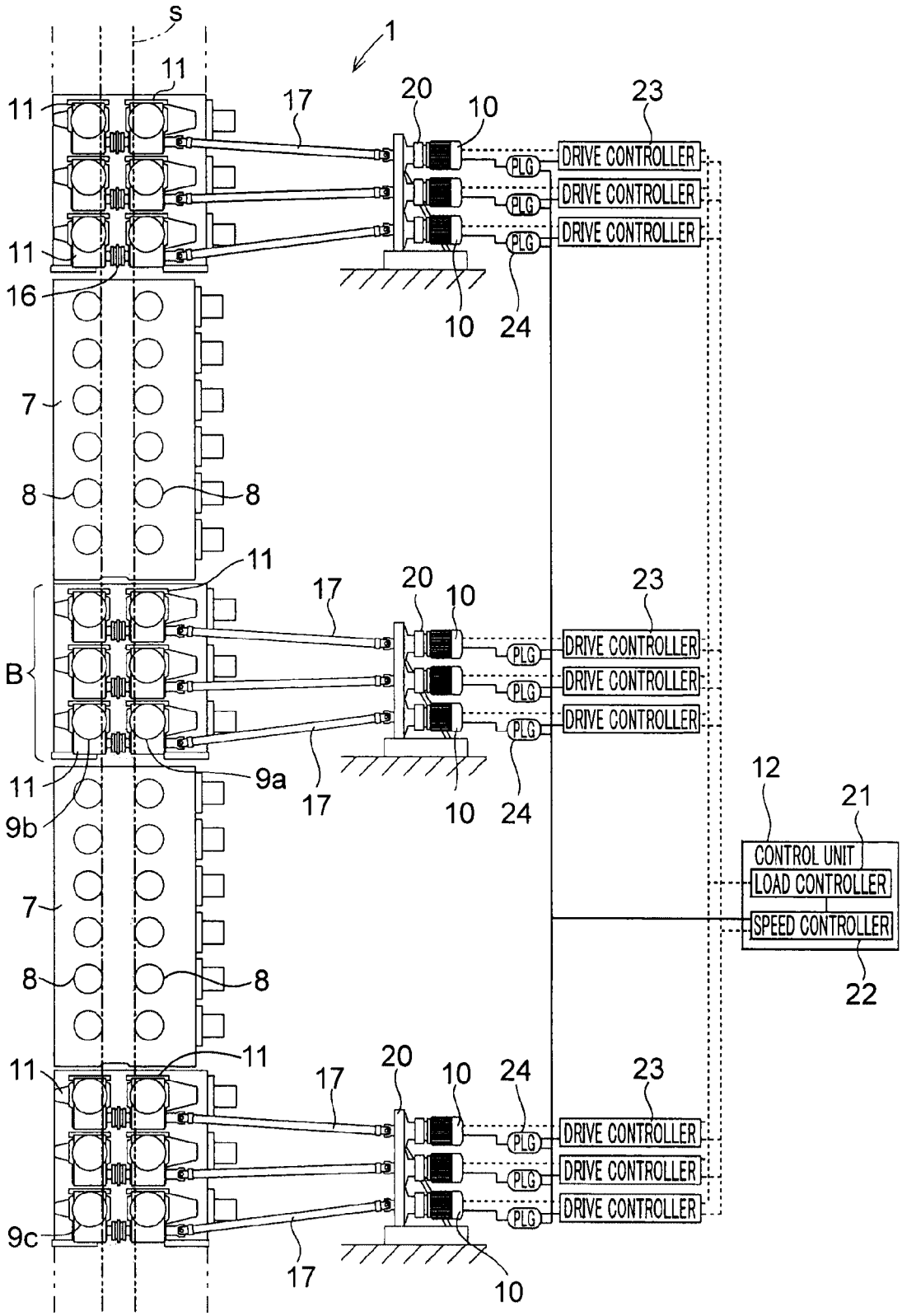
FIG. 2 is a schematic diagram showing a drive roller arrangement at part A marked in FIG. 1.

As shown in FIG. 2, the strand guiding apparatus 1 is an apparatus to guide the strand S withdrawn from the mold 6 in a moving direction or a vertical direction in FIG. 1. The strand guiding apparatus 1 includes a frame 7 arranged around the strand S to surround the strand S, a plurality of guide rollers 8 (free rollers) disposed in the frame 7 for guiding the strand S while sandwiching it, and drive rollers 9 for moving the strand S in the moving direction while sandwiching it.

The strand guiding apparatus 1 includes drive motors 10 for generating driving forces for drivingly rotating the drive rollers 9, worm reducers 11 for transmitting the driving forces of the drive motors 10 to the drive rollers 9 while reducing the driving speed or the rotational speed of the drive motor 10, and a control unit 12 for controlling the rotational speeds of the drive rollers 9 and/or the driving forces. The worm reducer changes the transmitting direction of the driving force to the axis of the drive roller 9 from the direction orthogonal to the axis of the drive roller 9.

Each drive roller 9 has a length longer than the width of a wider surface of the strand S, and can thus come into contact with the entire wider surface of the strand. Pairs of guide rollers 8 are arranged while being spaced apart in a horizontal direction, each pair of guide rollers 8 being rotatable about axes extending in the horizontal direction of the frame 7 and being able to guide the strand S while sandwiching the strand S therebetween. Further, a plurality of pairs of guide rollers are provided on the opposite narrower surfaces of the strand at a position near the mold 6 or right below the mold 6. However, description of the guide rollers provided on the narrower surfaces is hereinafter omitted for clarification.

As shown in FIG. 2, in the strand guiding apparatus 1 of this embodiment, six pairs of guide rollers 8 are arranged along the moving direction of the strand S and, below them, three pairs of drive rollers 9 are consecutively arranged. In this way, a plurality of pairs of guide rollers 8 and a plurality of pairs of drive rollers 9 are alternately arranged.

In this embodiment, nine pairs of drive rollers 9 are arranged in total. Each pair is composed of a drive roller 9*a* and a drive roller 9*b*. The drive roller 9*a* is held in contact with the surface of the strand S that is closer to the drive motor 10, and the drive roller 9*b* is held in contact with the surface of the strand S that is distant from the drive motor 10. In this embodiment, the distant surface of the strand S with which the drive roller 9*b* is held in contact serves as a reference surface. The strand S is sandwiched in the horizontal direction by these two drive rollers 9*a*, 9*b*, and conveyed in the vertical direction by them.

Each drive roller 9 has a shaft extending from the opposite ends thereof, and is rotatably supported on the frame 7 by supporting the shaft using an unillustrated bearing. The leading end of the shaft of the drive roller 9 penetrates through the frame 7 and projects out, and is coupled with the worm reducer 11.

Figure 5:
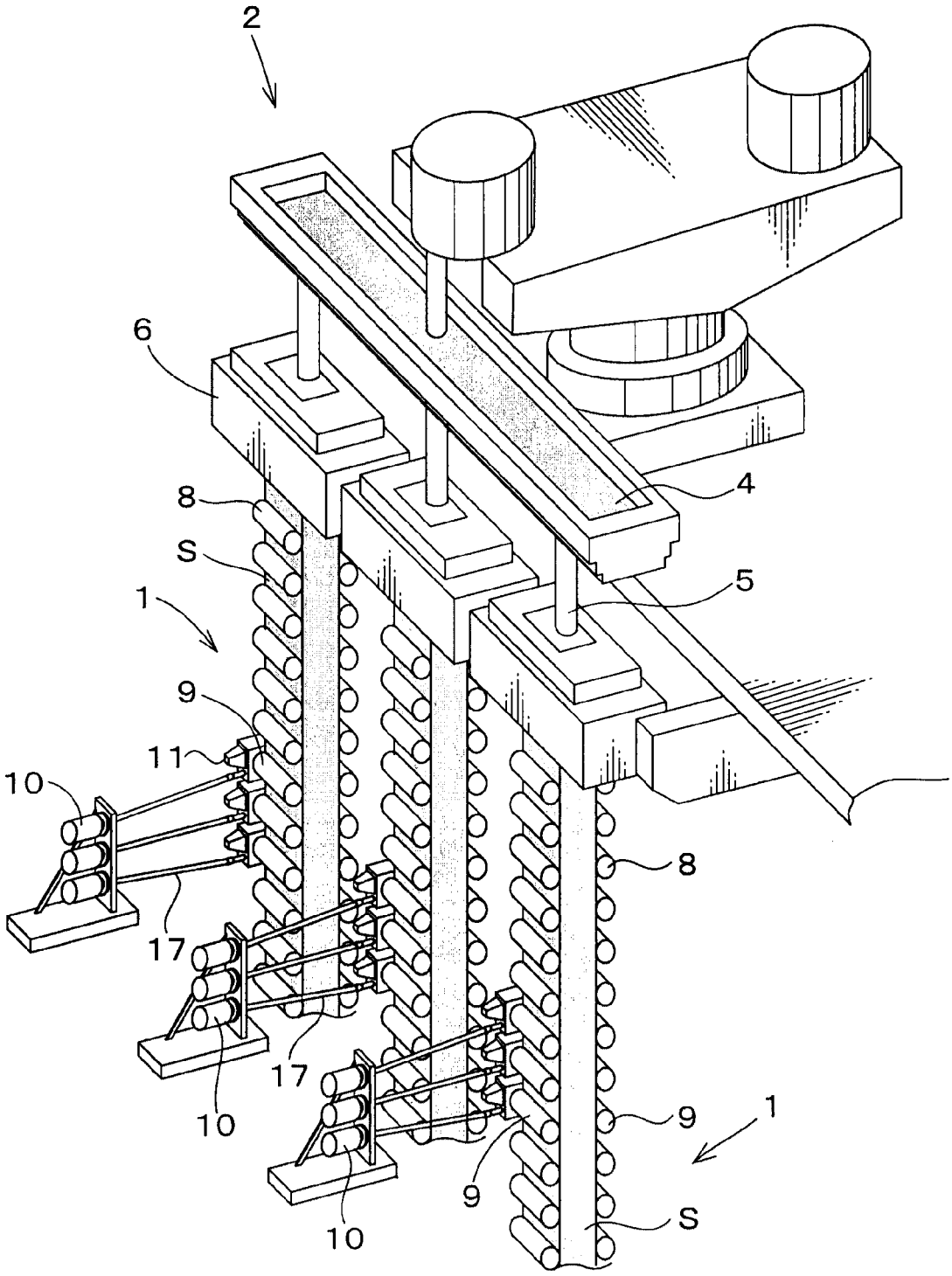
FIG. 5 is a perspective view of multi-strand continuous casting equipment using the strand guiding apparatus.

As shown in FIG. 5, the strand guiding apparatus 1 may be used in multi-strand continuous casting equipment capable of casting a plurality of strands. In this case, a plurality of strand guiding apparatuses may be provided for the plurality of strands, respectively.

Figure 3:
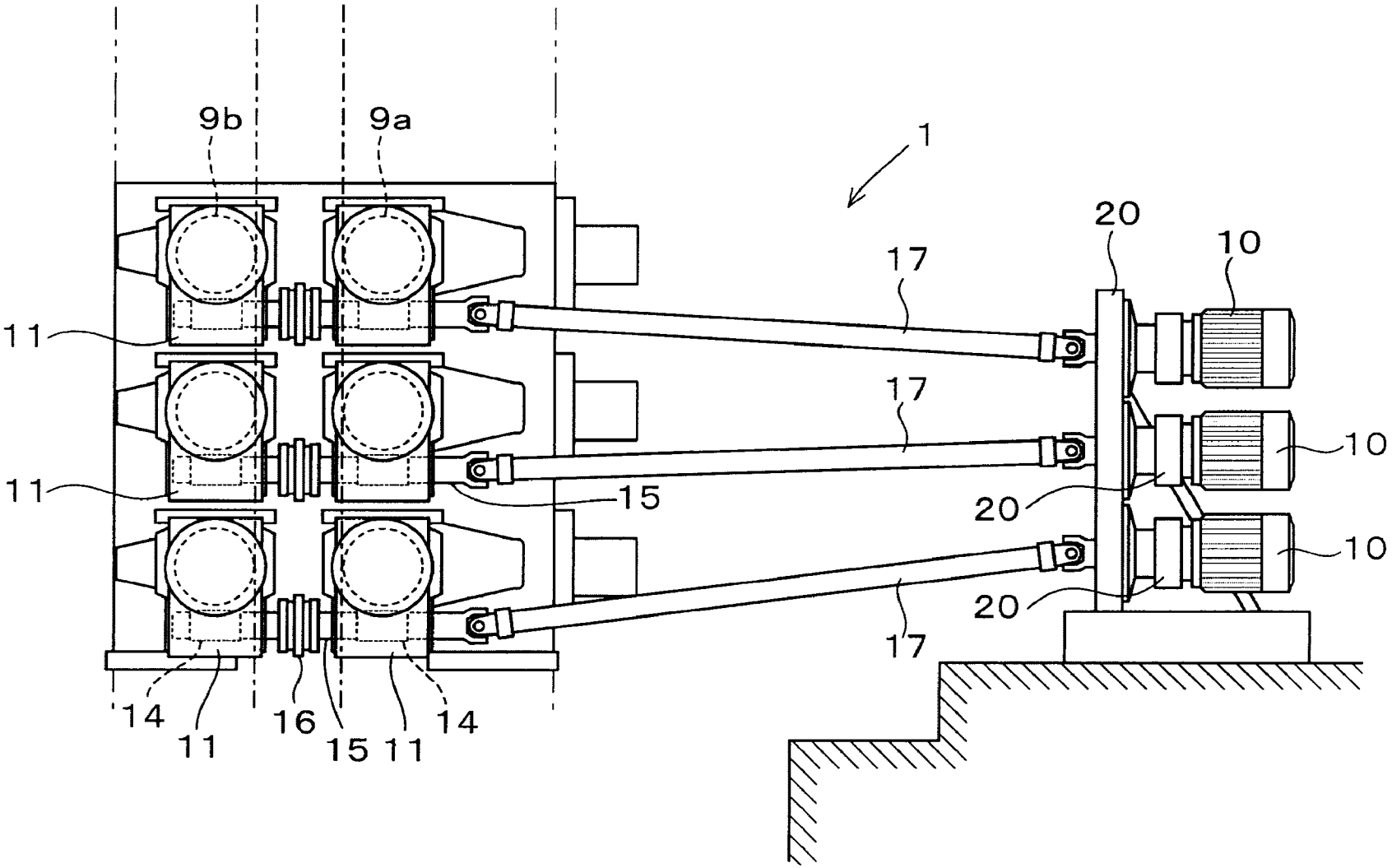
FIG. 3 is an enlarged view showing a drive roller arrangement at a part B marked in FIG. 2.
Figure 4:
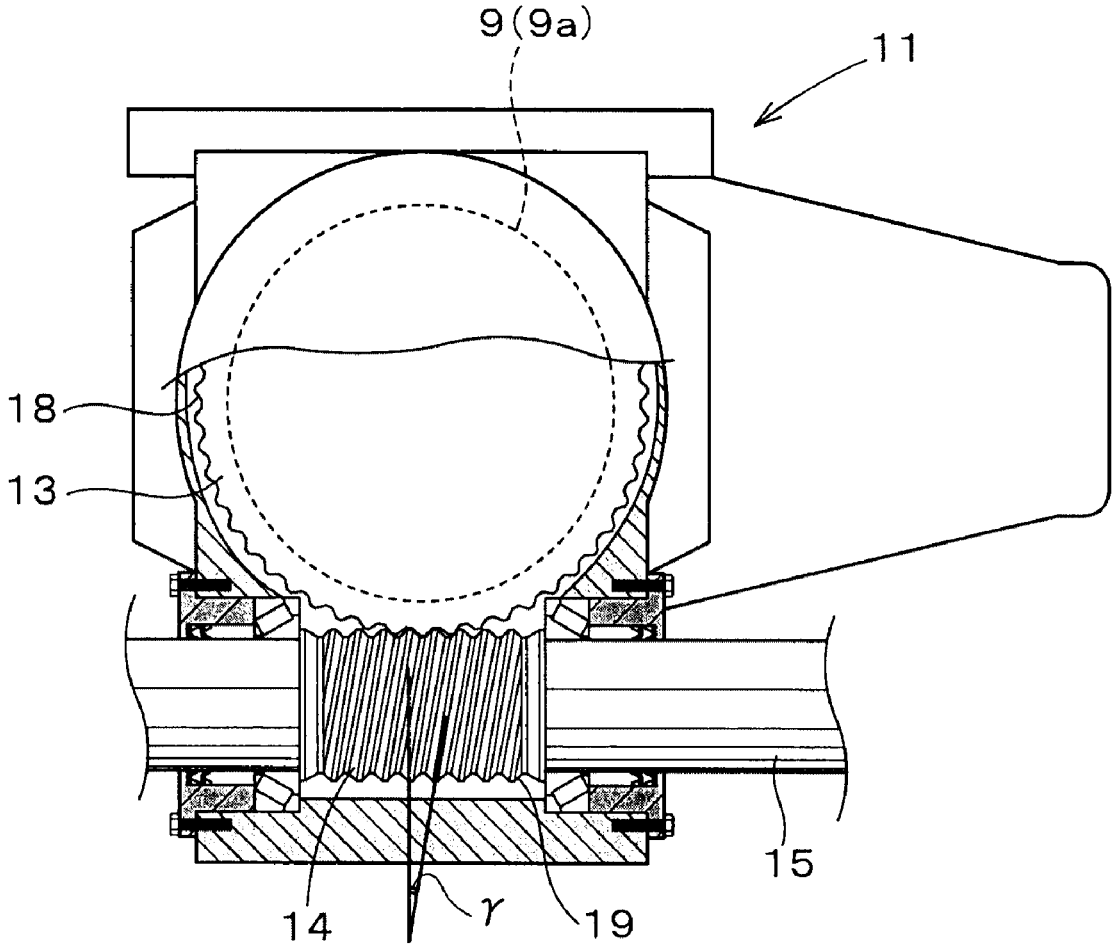
FIG. 4 is a partial front view in section of a worm reducer used in the strand guiding apparatus.

As shown in FIGS. 3 to 5, the worm reducer 11 is a device to transmit the driving force transmitted from the drive motor 10 via a universal joint 17 to the drive roller 9 while reducing the driving speed or the rotational speed of the drive motor 10. The worm reducer 11 is provided for each of the drive roller 9*b* at the reference surface side and the drive roller 9*a* at the other surface side. The worm reducer 11 includes a worm wheel 13 mounted on the shaft of each drive roller 9 and rotatable together with the drive roller 9, a worm 14 arranged in a direction orthogonal to the axis of each drive roller 9 and engaged with the worm wheel 13, and a worm shaft 15 for rotating the worm 14. Between the worm shaft 15 at the reference surface side and the worm shaft 15 at the other surface side is provided a coupling 16 for transmitting the driving force from the drive motor 10 to the two drive rollers 9 at the same time. In the strand guiding apparatus 1 according to this embodiment, the driving force from the drive motor 10 is transmitted via the coupling 16 to drive both the drive roller 9*b* at the reference surface side and the drive roller 9*a* at the other surface side, in other words, the common drive is performed.

In the case where the common drive is performed, however, the diameters of the drive roller 9*b* at the reference surface side and the drive roller 9*a* at the other surface side need to be strictly managed so that the circumferential speeds of the two rollers match to each other. In view thereof, it may be appreciated that the worm reducer 11 and the drive motor 10 for the drive roller 9*a* and the worm reducer 11 and the drive motor 10 for the drive roller 9*b* are arranged at the opposite sides of the strand S, and the respective drive rollers 9 are individually driven by the respective drive motors 10.

As shown in FIG. 4, in the worm reducer 11, speed reduction is carried out by engagement of teeth 18 formed on the outer circumferential surface of the worm wheel 13 and an externally threaded portion 19 formed on the outer circumferential surface of the worm 14. This external threaded portion 19 is formed to be at a lead angle γ to be described later to the axis of the worm shafts 15 in the sideway view of the worm 14, and a speed reduction ratio can be arbitrarily set by changing the lead angle γ of the worm 14, pitch diameter and teeth number of the worm wheel 13 or the like. This lead angle γ is set such that an absolute value thereof is the same, but with positive and negative signs for the drive roller 9*a* at the other surface side and the drive roller 9*b* at the reference surface side, so that the drive roller 9*a* and the drive roller 9*b* can be rotated in the opposite rotating directions from each other.

As shown in FIG. 3, the drive motors 10 are horizontally spaced apart from the drive rollers 9 in a direction perpendicular to the axes of the drive rollers 9. One drive motor 10 is provided for a pair of drive rollers 9. A primary speed reducer 20 including a planetary gear inside and the universal joint 17 are arranged between the drive motor 10 and the drive rollers 9.

The worm of the worm reducer 11 is made to have a lead angle γ which causes the driver rollers 9 to enter a non-self locking operational region. In other words, the worm reducer 11 is generally set at a speed reduction ratio of 1/40 or lower, preferably, 1/20 or 1/30. This worm reducer 11 will transmit a load generated on the drive rollers 9 to the drive motor 10. The worm reducer 11 is different from conventionally used worm reducers having a large speed reduction ratio of 1/40 to 1/60 or larger to prevent a strand from dropping actively using self-locking.

Figure 6:
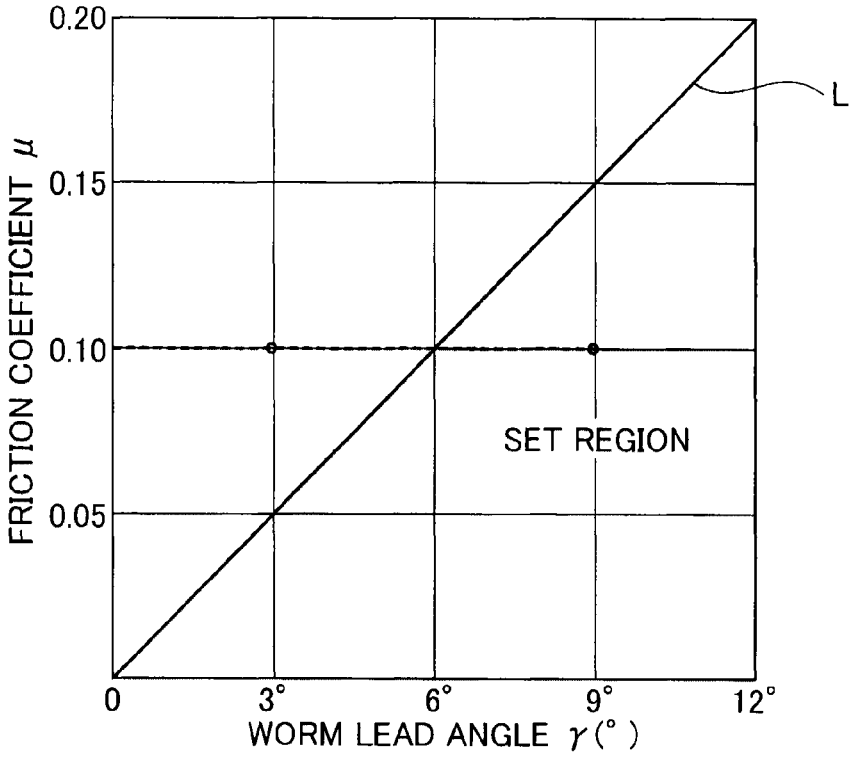
FIG. 6 is a graph showing a self-lock limit characteristic curve of the worm reducer.

Next, the lead angle γ of the worm 14 of the worm reducer 11 and the speed reduction ratio are described in detail. The lead angle γ of the worm 14 is an angle of the externally threaded portion 19 of the worm 14 with respect to the axis of the worm shafts 15 in the sideway view of the worm 14 as described above. FIG. 6 is a self-locking limit characteristic curve diagram showing a relationship between the lead angle γ of the worm 14 of a certain worm reducer 11 and a friction coefficient .mu. between the worm 14 and the worm wheel 13 with the lead angle γ represented by a horizontal axis and the friction coefficient represented by a vertical axis. A region above a self-locking limit characteristic curve L is a self-locking operational region where self-locking occurs and a region below the curve L is a non-self-locking operational region shown in gray in FIG. 6 where self-locking does not occur.

An exemplary case is considered where the worm 14 and the worm wheel 13 are made of a certain material and finished by polishing their surfaces, and the friction coefficient between the worm 14 and the worm wheel 13 is 0.10 as shown in FIG. 6 with lubricant supplied between them. At this time, in the worm reducer 11 including the worm 14 with a lead angle γ of 3°, self-locking occurs since the lead angle of 3° lies in the self-locking operational region. However, if the lead angle γ of the worm 14 is 6° or larger, e.g., 9°, it lies in the non-self-locking operational region, and self-locking does not occur.

Note that the self-locking limit characteristic curve L shown in FIG. 6 is an example. This is because the self-locking limit characteristic curve L changes according to a frictional state or lubricative state between the worm 14 and the worm wheel 13. Thus, it is preferable to obtain a self-locking limit characteristic curve by actual measurement upon strictly obtaining the non-self-locking operational region. However, preparation of such a self-locking limit characteristic curve is very cumbersome. Accordingly, it may be appreciated that a worm reducer having a speed reduction ratio of 1/40 or lower, e.g., 1/20 or 1/30 is employed, because it has been experienced that a worm reducer having a speed reduction ratio of 1/40 or lower does not cause self-locking.

If the lead angle γ of the worm 14 is set in the non-self-locking operational region as described above or if the worm reducer 11 having a speed reduction ratio of 1/40 or lower is used, self-locking does not occur in the worm reducer 11 and a load generated on the drive rollers 9 is transmitted to the drive motor 10 without any trouble. When the load occurring on the drive rollers 9 is transmitted to the drive motor 10, a load of the drive rollers 9 can be known from the load to the drive motor 10. Therefore, either one or the both of the rotational speed of the drive rollers 9 and the driving force can be controlled based on the load to the drive motor 10.

The strand guiding apparatus 1 further includes speed detectors 24 for detecting the rotational speeds of the drive motors 10, drive controllers 23 for controlling the outputs of the drive motors 10, and the control unit 12 for sending commands to the drive controllers 23 based on the rotational speeds of the drive motors 10 detected by the speed detectors 24. Next, the speed detector 24, the drive controller 23 and the control unit 12 are described.

The speed detector 24 is mounted on a drive shaft of the drive motor 10 to detect the rotational speed of the drive motor 10 from the rotational speed of this drive shaft. The speed detector 24 includes a pulse logic generator (PLG). One speed detector 24 is mounted on each drive motor 10 to detect the rotational speed of each drive motor 10, and sends the detected rotational speed to the control unit 12.

The drive controller 23 is a component for controlling the output of the drive motor 10, and is provided with a current control type inverter whose output is changed by changing a current supplied to the drive motor 10. The drive controller 23 includes a current controller (ACR) for controlling the current supplied to the drive motor 10 and a speed controller (ASR) for outputting a control signal corresponding to a speed to the current controller. One drive controller 23 is mounted on each drive motor 10 similar to the speed detector 24 to control the output of each drive motor 10.

The control unit 12 controls the rotational speeds of the drive rollers 9 and/or the driving forces based on loads to the drive motors 10 by a program installed therein, and includes a speed controller 22 and a load controller 21. Specifically, the control unit 12 is constructed by a computer or a PLC, and outputs control signals to the respective drive controllers 23 based on the rotational speeds of the drive motors 10 detected by the respective speed detectors 24, a casting speed entered beforehand, and the like.

The speed controller 22 is a device for rotating a reference drive roller 9*c* at a predetermined rotational speed so that the circumferential speed of the reference drive roller 9*c* out of a plurality of pairs of drive rollers 9 arranged in a vertical direction conforms to the predetermined casting speed. In this embodiment, the reference drive roller 9*c* is the one arranged bottommost out of the plurality of pairs of drive rollers 9 arranged in the vertical direction.

The casting speed of the strand S is given to the speed controller 22 beforehand, accordingly the rotational speed of the reference drive roller 9*c*, at which the strand S is cast at the casting speed given beforehand, can be calculated. A difference between the thus calculated rotational speed of the reference drive roller 9*c* and the rotational speed of the drive motor 10 actually detected by the speed detector 24 is calculated in the speed controller 22. Then, the calculated difference is fed back as a speed command, and the fed-back speed command is output to a speed controller of the drive controller 23, thereby executing a control to conform the rotational speed of the drive motor 10 to the casting speed given beforehand.

The reference drive roller 9*c* may be a drive roller other than the bottommost one. For example, the reference drive roller 9*c* may be uppermost one or one located at an intermediate vertical position out of the plurality of drive rollers 9. Further, a construction for arbitrarily selecting any one of the plurality of drive rollers 9 as a reference drive roller 9*c* may be adopted.

The load controller 21 executes a load sharing control for detecting the loads of the respective drive motors 10 for all the drive rollers 9 other than the reference drive roller 9*c* and, if the detected load exceeds the predetermined load, an excess load is shared by the other drive motors 10. This load sharing control is executed by setting a droop characteristic for each drive motor 10 and outputting a speed command of the rotational speed obtained by multiplying a load variation of each drive motor 10 by a droop rate to the current controller of the drive controller 23.

Figure 7:
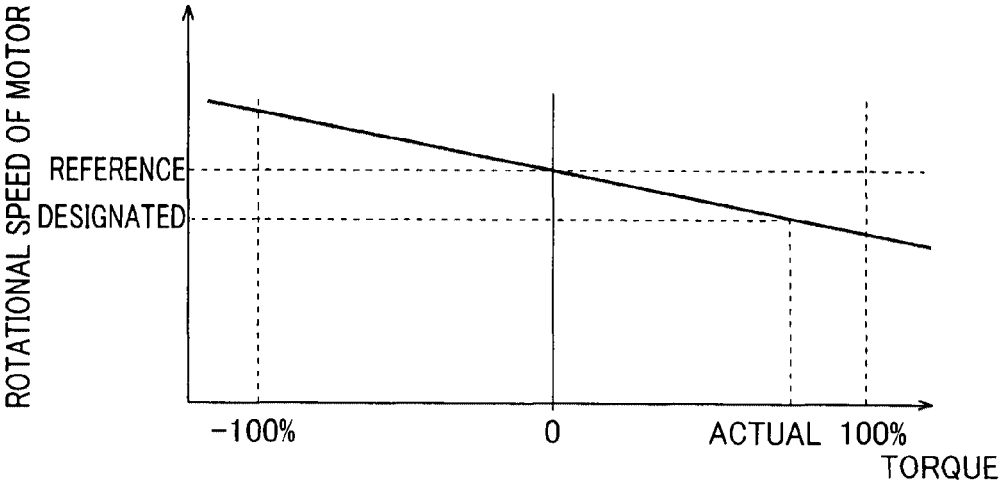
FIG. 7 is a graph showing a relationship between a torque input to a control unit and a command value concerning a rotational speed output from the control unit.

FIG. 7 shows the control based on the droop characteristic. Specifically, a torque of the drive motor 10 generated when the drive roller 9 rotates at the same speed as the rotational speed of the reference drive roller 9*c* is a reference torque. The command value for the rotational speed is reduced according to the droop rate if a torque (torque command) actually required by the drive motor 10 is larger than this reference torque while being increased according to the droop rate if the torque (torque command) is lower than the reference torque.

The use of such a droop characteristic makes it possible that the load controller 21 prevents action of an excessive load to a certain drive motor 10 by reducing the command value of the rotational speed of the drive motor 10, when the load to the certain drive motor 10 increases. Simultaneously, the drive motors 10 other than the one whose load has increased receive increased works by as much as the reduced rotational speed of the drive motor whose load has increased. Consequently, a load balance among the drive motors 10 will be attained.

Besides the above-described load sharing control utilizing the droop characteristic, the following control can be executed as the load sharing control. A torque of the reference drive roller 9*c* can be used for control of torque compensations to the drive rollers 9 other than the reference drive roller 9*c* by driving the reference drive roller 9*c* by a PI control and driving the drive rollers 9 other than the reference drive roller 9*c* by a P control.

Specifically, when the load acting on the reference drive roller 9*c* is larger than those acting on the drive rollers 9 other than the reference drive roller 9*c*, torque compensations acting on the drive rollers 9 other than the reference drive roller 9*c* become positive to increase their respective rotational speeds, whereby the loads on the drive rollers 9 other than the reference drive roller 9*c* increase. On the other hand, when the load on the drive roller 9 other than the reference drive roller 9*c* increases, the load on the reference drive roller 9*c* decreases. As a result, a load balance between the reference drive roller 9*c* and the drive rollers 9 other than the reference drive roller 9*c* is adjusted.

Another method may be adopted. Specifically, instead of directly using the torque of the reference drive roller 9*c* as the torque compensations, a reference torque to be shared by the respective drive rollers 9 is calculated and deviations from the reference torques are used as torque compensations. Note that the reference torque may be obtained, for example, by dividing the sum total of the loads acting on all the drive rollers 9 including the reference drive roller 9*c* by the total number of the drive rollers 9.

As described above, the following functions and effects can be expected in the strand guiding apparatus 1 which is used in the continuous casting equipment.

The worm reducer 11 including the worm 14 whose lead angle $\gamma$ is set in the non-self-locking operational region, or generally the worm reducer 11 set at a speed reduction ratio of 1/40 or lower can transmit the load occurring on the drive roller 9 to the drive motor 10 without causing self-locking in the worm reducer 11. Thus, the outputs of the plurality of drive motors 10 can be reliably adjusted according to the loads on the drive rollers 9 while checking the loads on the drive rollers 9.

In the case where the load sharing control as described above is used, the rotation of the drive rollers can be controlled while the rotational speeds and torques are balanced among the plurality of drive rollers 9 by reducing the rotational speed and torque for the drive roller having a large load placed thereon and increasing the rotational speed and torque for the drive roller 9 having a small load placed thereon.

Particularly, in the case of vertical continuous casting equipment in which a falling force from the strand S directly acts on the drive rollers 9, the plurality of drive motors 10 are either in a reverse-powering where the drive roller 9 is to rotate the drive motor 10 or in a powering state where the drive motor 10 rotates the drive roller 9, and the outputs of the drive motors 10 need to be adjusted according to their respective operation states. Even in this case, the strand guiding apparatus, which adjusts the outputs of the drive motors 10 according to the loads on the drive rollers 9 respectively, can efficiently control the outputs of the plurality of drive motors 10 according to the driving condition. Accordingly, there is no likelihood that the worm reducers 11 are damaged by excessive loads.

Since the plurality of drive motors 10 can be controlled while being balanced in the strand guiding apparatus 1, the plurality of drive rollers 9 will have different circumferential speeds from one another. Accordingly, the strand guiding apparatus 1 can eliminate the problem that slippage occurs between the strand and surfaces of the drive rollers to lower the surface quality of the strand, and the problem that a force acts in a tensile direction or compression direction to cause "chatter" of the strands.

Further, the strand guiding apparatus 1 remains to have the effect obtained by using the worm reducers 11, i.e., the effect of reducing the installation space and obtaining a large speed reduction rate. Thus, the strand guiding apparatus 1 is particularly preferable for the multi-strand continuous casting equipment 2 which has a limited installation space. However, the strand guiding apparatus 1 is not limited to the above embodiments and various changes and modifications are possible without changing the substance of the invention. For example, the strand guiding apparatus 1 is described in the embodiment with reference to the use in the vertical continuous casting equipment 2. However, the strand guiding apparatus 1 may be used, for example, in vertical and bending continuous casting equipment.

In the above-described embodiments, the plurality of drive rollers 9 are arranged in the moving direction of the strand S in the strand guiding apparatus 1. However, it may be appreciated that only one pair of drive rollers is provided to guide the strand. This construction having only one pair of driver rollers will accomplish the above-mentioned advantageous effects.

In the above-described embodiments, the drive roller 9*a* at the other surface side and the drive roller 9*b* at the reference surface side are driven by one drive motor 10. However, it may be appreciated that a drive roller is provided either at the reference surface side of the strand S or at the other surface side, but a freely drivable roller is provided at the remaining side as far as this construction does not cause any problem with the ability to hold the strand S. Alternatively, two drive motors may be provided at the reference surface side of strand S and at the other surface side to individually drive the pair of drive rollers.

In the above-described embodiments, out of the plurality of drive rollers 9 arranged in the vertical direction, the speed control is executed for the reference drive roller 9*c* and the load sharing control is executed for the drive rollers 9 other than the reference drive roller 9*c*. However, the load sharing control may be applied for all the drive rollers 9 including the reference drive roller 9*c*.

As described above, a novel strand guiding apparatus for continuous casting equipment, comprises: a pair of rollers for sandwiching a strand; a drive motor for generating a driving force to drive at least one of the pair of rollers; a worm reducer for transmitting the driving force of the drive motor to the at least one of the pair of rollers while reducing the rotational speed of the drive motor, the worm reducer having a worm extending in a direction orthogonal to an axis of the at least one of the pair of rollers, and operable to transmit a load occurring at the roller to the drive motor; and a control unit for controlling the rotational speed of the roller and/or the driving force of the drive motor based on the load to the drive motor. In this arrangement, in addition to the fact that the advantage of the worm reducer requiring a smaller space can be held, the rotational speed of the roller can be controlled at a desired speed more reliably. Accordingly, casting can be performed without lowering the surface quality of the strand and causing chatter.

The strand guiding apparatus may be further provided with another drive motor for driving the other one of the pair of rollers. The drive motor may drive the both of the pair of rollers, and another worm reducer transmits the driving force of the drive motor to the other roller.

Moreover, the strand guiding apparatus may be further provided with another pairs of rollers arranged along a moving direction of the strand for sandwiching the strand; another drive motors for generating driving forces to drive the another pairs of rollers; another worm reducers for transmitting the driving forces of the another drive motors to the another pairs of rollers while reducing the rotational speed of the drive motors, each worm reducer having a worm extending in a direction orthogonal to an axis of the corresponding roller, and operable to transmit a load occurring on the roller to the corresponding drive motor. The control unit controls the respective rotational speeds of the rollers and/or the respective driving forces of the drive motors based on the load to the drive motors. The provision of the plurality of pairs of rollers can guide the strand more reliably.

Also, the strand guiding apparatus may be further provided with a detector for detecting loads to the drive motors. The control unit judges on a detection of the detector whether a load to a specified drive motor exceeds a predetermined load, and executes a load sharing control to cause the other drive motors to share an excess load when the load to the specified drive motor is judged to exceed the predetermined load. In this arrangement, the load sharing control is executed. Accordingly, the respective plurality of the rollers can be strictly conformed to the moving speed of the strand while the loads are balanced among the plurality of rollers.

The strand guiding apparatus may be further provided with a reference drive roller for giving a reference moving speed to the strand; a further drive motor for generating a driving force to drive the reference drive roller; a further worm reducer for transmitting the driving force of the further drive motor to the reference drive roller while reducing the rotational speed of the further drive motor. The control unit allows the reference drive roller to rotate without executing the control of the rotational speed of the roller and/or the driving force of the further drive motor. In this arrangement, the reference drive roller is provided. Accordingly, the control can be performed more reliably.

The worm of the worm reducer may have a lead angle which is in a non-self-locking operational region. The worm reducer having such a lead angle can perform the speed reduction in a simpler construction.

The worm reducer may preferably be made to reduce the rotational speed of the drive motor at a speed reduction rate of 1/40 or lower. It has been known that the self-locking does not occur in the case where a normally available worm reducer is set at a speed reduction ratio of 1/40 or lower, thereby enabling the load occurring on the roller to be reliably transmitted to the drive motor. Accordingly, the use of the worm reducer having a speed reduction of 1/40 or lower can ensure the transmission of the load occurring on the roller to the drive motor without doing the cumbersome preparation of self-locking limit characteristic curve to define a relationship between a frictional state or slippery state and the lead angle of the worm.

The strand guiding apparatus may be installed in vertical continuous casting equipment. In vertical continuous casting equipment, the drive rollers are likely to enter a reverse-powering state since most of the weight of a strand or a dummy bar act on the drive rollers. However, the respective rotational speeds of the drive rollers are controlled based on the loads transmitted from the drive rollers to the drive motors in this arrangement. The reverse-powering condition of the drive roller is transmitted as a load to the drive motor. Therefore, the drive motor can be operated or controlled according to the reverse-powering state.

Also, the strand guiding apparatus may be installed in multi-strand continuous casting equipment operable to continuously cast a plurality of strands. The worm reducers are arranged between adjacent strands. The arrangement of the worm reducers between the adjacent strands enables the drive motors and the like for supplying the driving forces to the worm reducers to be installed at such positions as not to positionally interfere with the strands. Accordingly, a plurality of strand guiding apparatuses can be reliably installed even in multi-strand continuous casting equipment having a limited installed space.

The strand guiding apparatus may be further provided with a primary speed reducer between the worm reducer and the drive motor for transmitting the driving force of the drive motor to the worm reducer while reducing the rotational speed of the drive motor. This arrangement, in which the drive force is reduced by the primary speed reducer and further reduced by the worm reducer, enables the use of a small-sized primary speed reducer and universal joints because a large speed reduction ratio is managed by the worm reducer.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A strand guiding apparatus for continuous casting equipment, comprising:

at least two pairs of rollers, each pair of said pairs of rollers being provided for sandwiching a strand, the two pairs of rollers being mutually arranged in the vertical direction such that the strand is guided to move in a vertical direction in accordance with contact with the at least two vertically arranged pairs of rollers;

a drive motor for generating a driving force to drive at least one roller of at least one of the pairs of rollers;

a worm reducer for transmitting the driving force of the drive motor to the at least one roller of the at least one of the pairs of rollers while reducing the rotational speed of the drive motor, the worm reducer having a worm extending in a direction orthogonal to an axis of the at least one roller of the at least one of the pairs of rollers, and operable to transmit a load occurring at the roller to the drive motor; and a control unit for controlling the rotational speed of the at least one roller and/or the driving force of the drive motor based on the load to the drive motor, and wherein the worm of the worm reducer has a lead angle providing a speed reduction rate of 1/40 or lower so that the worm reducer is in a non-self-locking operational region.

2. A strand guiding apparatus according to claim 1, further comprising another drive motor for driving the other roller of the at least one of the pairs of rollers.

3. A strand guiding apparatus according to claim 1, wherein the drive motor drives both of the rollers of each of the at least two pairs of rollers, further comprising another worm reducer for transmitting the driving force of the drive motor to the other roller.

4. A strand guiding apparatus according to claim 1, further comprising:

another pair of rollers of the at least two pairs of rollers, the one pair of rollers and the another pair of rollers being mutually arranged along the vertical moving direction of the strand for sandwiching the strand;

another drive motor for generating driving forces to drive the another pair of rollers;

another worm reducer for transmitting the driving forces of the another drive motor to the another pair of rollers while reducing the rotational speed of the drive motors, each worm reducer having a worm extending in a direction orthogonal to an axis of the corresponding roller, and operable to transmit a load occurring on the roller to the corresponding drive motor; and wherein the control unit controls the respective rotational speeds of the rollers and/or the respective driving forces of the drive motors based on the load to the drive motors.

5. A strand guiding apparatus according to claim 4, further comprising a detector for detecting loads to the drive motors, wherein the control unit judges on a detection of the detector whether a load to a specified drive motor exceeds a predetermined load, and executes a load sharing control to cause the other drive motor to share an excess load when the load to the specified drive motor is judged to exceed the predetermined load.

6. A strand guiding apparatus according to claim 4, further comprising:

a reference drive roller for giving a reference moving speed to the strand, a further drive motor for generating a driving force to drive the reference drive roller;

a further worm reducer for transmitting the driving force of the further drive motor to the reference drive roller while reducing the rotational speed of the further drive motor, wherein the control unit allows the reference drive roller to rotate without executing the control of the rotational speed of the roller and/or the driving force of the further drive motor.

7. A strand guiding apparatus according to claim 4, wherein each drive motor generates the driving force to the both of each pair of rollers.

8. A strand guiding apparatus according to claim 4, wherein each drive motor generates the driving force to one of each pair of rollers, and the other of each pair of rollers is freely rotatable without the driving force.

9. A strand guiding apparatus according to claim 4, which is installed in multi-strand continuous casting equipment operable to continuously cast a plurality of strands, wherein the worm reducer is arranged between adjacent strands.

10. A strand guiding apparatus according to claim 4, further comprising a speed reducer provided between the worm reducer and the drive motor for transmitting the driving force of the drive motor to the worm reducer while reducing the rotational speed of the drive motor.

11. A strand guiding apparatus according to claim 1, which is installed in multi-strand continuous casting equipment operable to continuously cast a plurality of strands, wherein the worm reducer is arranged between adjacent strands.

12. A strand guiding apparatus according to claim 1, further comprising a speed reducer provided between the worm reducer and the drive motor for transmitting the driving force of the drive motor to the worm reducer while reducing the rotational speed of the drive motor.

13. A strand guiding apparatus for continuous casting equipment, comprising:

a pair of rollers for sandwiching a strand;

a drive motor for generating a driving force to drive at least one of the pair of rollers;

a worm reducer for transmitting the driving force of the drive motor to the at least one of the pair of rollers while reducing the rotational speed of the drive motor, the worm reducer having a worm extending in a direction orthogonal to an axis of the at least one of the pair of rollers, and operable to transmit a load occurring at the roller to the drive motor; and a control unit for controlling the rotational speed of the roller and/or the driving force of the drive motor based on the load to the drive motor, wherein the strand is guided to move in a vertical direction in accordance with contact with the pair of rollers; and wherein the worm of the worm reducer has a lead angle which is in a non-self-locking operational region, wherein the drive motor generates a driving force to drive both of the pair of rollers, further comprising another worm reducer for transmitting the driving force of the drive motor to the other of the pair of rollers while reducing the rotational speed of the drive motor, the another worm reducer having a worm formed on another shaft extending in another direction orthogonal to an axis of the other of the pair of rollers and operable to transmit a load occurring at the other roller to the drive motor, wherein the another shaft of the another worm reducer is coupled with a shaft formed with the worm of the worm reducer.

* * * * *